US007166012B2

(12) United States Patent
Lau

(10) Patent No.: US 7,166,012 B2
(45) Date of Patent: Jan. 23, 2007

(54) BRASSIERE AND MOLDED BREAST CUP CONSTRUCTION THEREFOR AND RELATED METHOD OF MANUFACTURE

(75) Inventor: Bull Lau, Hong Kong (HK)

(73) Assignee: Regina Miracle International Limited, Hong Kong (HK)

( * ) Notice: Subject to any disclaimer, the term of this patent is extended or adjusted under 35 U.S.C. 154(b) by 91 days.

(21) Appl. No.: 10/860,102

(22) Filed: Jun. 3, 2004

(65) Prior Publication Data

US 2005/0272345 A1 Dec. 8, 2005

(51) Int. Cl.
*A41C 3/10* (2006.01)
*A41C 3/14* (2006.01)

(52) U.S. Cl. ..... 450/39; 450/57; 2/267

(58) Field of Classification Search ..... 450/39, 450/54–57; 2/267, 268; 623/7, 8; 156/77–79, 156/242, 246; 264/46.4, 46.6
See application file for complete search history.

(56) References Cited

U.S. PATENT DOCUMENTS 6,042,608 A * 3/2000 Ishikawa et al. ..... 623/7

* cited by examiner

*Primary Examiner*—Gloria M. Hale
(74) *Attorney, Agent, or Firm*—Ostrolenk, Faber, Gerb & Soffen, LLP

(57) ABSTRACT

A breast cup for a brassiere including a flexible molded core panel trimmed to a breast cup form having a neckline perimeter and a front panel affixed to the core with a least part of the perimeter of the front panel extending beyond the neckline perimeter of the molded core, the extended portion defining a strip, a method and the product comprises folding the strip and then affixing the strip with the flexible molded core panel. Alternatively, the same product and method may be done with a back panel in order to give a selected neckline appearance. A brassiere having the molded core, the front panel or perhaps the rear panel, and the folded over strip.

67 Claims, 9 Drawing Sheets

BRASSIERE AND MOLDED BREAST CUP CONSTRUCTION THEREFOR AND RELATED METHOD OF MANUFACTURE

FIELD OF INVENTION

The present invention relates to a brassiere and molded breast cup construction therefor, or for a garment and to a related method of manufacture and in particular although not solely to a molded breast cup construction and a method of producing such a breast cup which incorporates a panel of a contrasting appearance.

The present invention also relates to a molded breast cup incorporated with other components to define a brassiere or other garment of clothing which may be defined by the methods of the present invention.

BACKGROUND OF THE INVENTION

Brassieres which incorporate a breast cup construction of a molded or moldable material are becoming more prevalent. One of the advantages of a molded breast cup construction is that is has a more simplified method of manufacture. Normally, using a molded breast cup construction will reduce the number of panels required to define the breast cup since a three dimensional cup form can be formed by a molding step. Traditionally, cups have been formed by stitching a plurality of panels together to define the three dimensional cup form.

However, a breast cup construction of a basic molded form has a reasonably plain appearance. Unlike the traditionally multi panel, sewn form of cup constructions, the molded cup form generally consists of a single panel of material with a foam core and in general does not incorporate significant detailing to enhance the appearance of the breast cup. Furthermore, since the breast cup is of a molded construction, it can be difficult to add to it, by subsequent sewing or stitching, any enhancements to the breast cup construction after it has been formed, especially to regions other than the perimeter of the cup, since such stitching will compress the foam core and may have unappealing visual effects on the appearance of the cup. Furthermore, prior to forming, the pre-form sheet materials do not conveniently lend themselves to the addition of enhancements which can, along with the pre-form, be conveniently molded to define a suitable breast cup shape.

The traditional form of sewn panel breast cup constructions have incorporated panels of contrasting appearance. In particular, such traditional breast cups have included a panel or panels of lace material incorporated with a silk or other general coverage material defining the breast cup construction. But such breast cups are expensive to make due to the higher labor content in the cost of their manufacture.

Molded breast cups are now in common use. But their methods of manufacture must take the final visual appearance of the cup into consideration, particularly the manner in which the perimeter of the cups are finished to enable a visually appealing cup to be formed. One of the aims in manufacturing such cups at low cost is to reduce any stitching. However, at the neck line perimeter region of a cup, a trim and tidy looking edge is necessary. Overlocking stitching is one way to cover the exposed edges of the cup form. However, such stitching is time consuming and may not be desired as it does change the appearance of the cup.

Accordingly, it is an object of the present invention to provide a breast cup of a brassiere and a related method of producing it, which can conveniently incorporate a panel of contrasting appearance in the cup to enhance the outward appearance of the breast cup or which will at least provide the public with a useful choice.

It is also an object of the present invention to provide a breast cup of a brassiere including a related method of producing it, which has a trimmed neck line edge that is provided in a manner that overcomes the above mentioned disadvantages or which will at least provide the public with a useful choice.

BRIEF DESCRIPTION OF THE INVENTION

In a first aspect, the present invention consists in a method of making a breast cup for a garment of clothing comprising the steps of:

(a) affixing a flexible panel (herein after "front panel") which is or includes a ply of fabric material, to the convex side of at least part of a flexible molded core panel which includes at least a foam ply, the flexible molded core panel having been molded and perimeter trimmed to a breast cup form including the perimeter which will be a neckline trimmed to the desired neckline perimeter shape, wherein the front panel is affixed in a position such that (i) at least part of its perimeter extends beyond the neckline perimeter of the molded breast cup form of the flexible molded core panel, for defining a strip of the front panel extending beyond and along at least part of the neckline perimeter, and (ii) the ply of fabric material of the front panel is the convex side ply of the front panel, (b) folding the strip and (c) affixing the strip to the flexible molded core panel at the concave side thereof.

The method preferably further comprises cutting the front panel to define the strip by cutting the front panel along a path outwardly to the neckline perimeter of the flexible molded core panel, wherein the cutting occurs after the first mentioned affixing and before the folding steps.

The front panel is preferably pre-cut prior to being affixed to the flexible molded core panel at least at a perimeter thereof to extend adjacent the neckline perimeter of the flexible molded core panel.

The flexible molded core panel preferably includes at its concave side a flexible panel (herein after "back panel") which is or includes a ply of fabric material that is affixed prior to affixing step (a) to the foam ply such that the ply of fabric material is the concave side ply of the back panel, and wherein the affixed back panel is of the same perimeter shape as the foam ply and the affixing of step (c) directly engages the strip to the back panel.

The affixing of step (a) is preferably adhesive affixing facilitated by a molding device having two mold portions, each portion with a complementary cup shaped molding surface between which the front panel and the flexible molded core panel are placed to be pressed together thereby.

The affixing of step (a) is preferably by adhesive pressure molding.

The affixing of step (a) preferably includes the use of adhesive.

The affixing of step (a) is preferably by elevated temperature melt bonding.

Prior to its cutting, a perimeter of the front panel extends beyond all of the perimeter sides of the flexible molded core panel.

The folding of step (b) preferably creates a fold line of the front panel at the neckline perimeter of the flexible molded core panel.

The cutting to define the strip is preferably along a path parallel to the neckline perimeter.

The cutting to define the strip is preferably along a path parallel to the neckline perimeter and less that 5 cm away therefrom.

The affixing step (c) is preferably by providing adhesive material to the strip on its side that is to become affixed.

The adhesive material is preferably a double sided adhesive tape applied to along the strip before the folding step.

Once it is affixed, the front panel preferably has a perimeter shape in which at least part of its perimeter is within the perimeter of the flexible molded core panel, the flexible molded core panel including at its convex side a base ply of flexible fabric material which is positioned intermediate the front panel and the flexible molded core panel.

The flexible molded core panel preferably includes a base ply of flexible fabric material disposed to the convex side of the foam ply and positioned intermediate the front panel and the foam ply.

The ply of fabric material of the front panel is preferably cut prior to the affixing of step (a) to a provide a decorative shape perimeter, and the decorative shape perimeter is positioned after the affixing of step (a) inward of the perimeter of the flexible molded core panel.

Preferably the ply of fabric material of the front panel is of a different color than the base ply.

The front panel is preferably only of the ply of fabric material.

In a second aspect, the present invention consists of a method of making a breast cup for a clothing garment comprising the steps of:

(a) affixing a flexible panel (herein after "back panel") which is or includes a ply of fabric material, to a concave side of at least part of a flexible molded core panel which includes at least a foam ply, the flexible molded core panel having been molded and perimeter trimmed to a breast cup form comprising a neckline perimeter trimmed to the desired neckline perimeter shape, wherein the back panel is affixed in a position such that (i) at least part of its perimeter extends beyond the neckline perimeter of the molded breast cup form of the flexible molded core panel, and this defines a strip of back panel extending beyond and along at least part of the neckline, and (ii) the ply of fabric material of the back panel is the concave side ply of the back panel, (b) folding the strip and (c) affixing the strip with the flexible molded core panel to the convex side thereof.

After the affixing step (c), a flexible panel (herein after "front panel"), which is or includes a ply of fabric material, is preferably affixed to the convex side of the flexible molded core panel, wherein the front panel is of a size larger than the perimeter size of the flexible molded core panel.

The front panel is preferably trimmed to the same perimeter size as the flexible molded core panel.

In a further aspect the present invention consists of a molded breast cup construction comprising:

a. a flexible molded core panel which includes at least a foam ply which has been molded and trimmed to a breast cup form which includes a neckline perimeter b. a flexible panel (hereinafter "front panel") which is or includes a ply of fabric material affixed to the convex side of at least part of the flexible molded core panel, wherein the front panel is affixed in a position such that a perimeter strip thereof extends about the neckline perimeter and is affixed to the concave side of said flexible molded core panel.

The front panel is preferably of the same perimeter shape as the flexible molded core panel.

The perimeter strip is preferably of a constant width.

The perimeter strip preferably extends along the entire neckline perimeter of the flexible molded core panel.

The flexible molded core panel preferably includes a base ply on its convex side to which the front panel is affixed.

A flexible panel (hereinafter "back panel") which is or includes a ply of fabric material is preferably affixed to the concave side of at least part of the flexible molded core panel.

The back panel is preferably affixed to the concave side of the entire flexible molded core panel.

Except at its neckline perimeter, the front panel is cut to define a decorative perimeter shape which extends across the flexible molded core panel, and the front panel appears different than the convex side of the flexible molded core panel.

The front panel is preferably affixed by laminated adhesive molding.

In a further aspect, the present invention consists of a brassiere incorporating a molded breast cup as described above.

In a further aspect, the present invention consists of a garment incorporating a molded breast cup as hereinbefore described above.

In a further aspect, the present invention consists of a molded breast cup made according to the method as described above.

In a further aspect, the present invention consists of a method of making a decorative molded breast cup for a garment of clothing comprising the steps of:—

(a) affixing a flexible panel (hereinafter "front panel"), which is or includes a ply of fabric material with part of its perimeter cut to define a decorative perimeter shape, to the convex side of at least part of a flexible molded core panel which includes at least a foam ply which has been molded and trimmed to a breast cup form, wherein the front panel is affixed in a position such that its decorative perimeter extends across at least part of the flexible molded core panel, said front panel having contrasting appearance to the convex side of the molded core panel.

Any portions of the front panel extending beyond the perimeter of the flexible molded core panel are trimmed to the same desired perimeter shape.

Portions of the front panel extending beyond the perimeter of the flexible molded core panel are trimmed to the same perimeter shape as the flexible molded core panel.

The front panel is preferably of a contrasting color to the convex side of the flexible molded core panel.

The front panel is affixed to the flexible molded core panel, preferably prior to the trimming, in a position such that the decorative perimeter edge extends across at least part of the flexible molded core panel and a non-decoratively cut perimeter extends beyond the perimeter of the flexible molded core panel.

The flexible molded core panel preferably includes a base ply of a flexible fabric material provided on the convex side of the foam ply and onto which the front panel is affixed.

The base ply is preferably of the same perimeter shape as the foam ply.

The decorative perimeter shape of the front panel is preferably created by laser cutting or fluid jet cutting.

The front panel has been created to have apertures inward of the perimeter.

The apertures are preferably created by laser cutting or fluid jet cutting.

The affixing of step (a) is preferably an adhesive affixing facilitated by a molding device having two mold portions, each with a complementary cup shaped molding surface and between which the front panel and the flexible molded core panel are placed to be pressed together thereby.

The affixing of step (a) is preferably by adhesive pressure molding.

The affixing of step (a) preferably includes the use of an adhesive.

The affixing of step (a) is preferably by elevated temperature melt bonding.

Prior to the trimming, the front panel is preferably at least in part of a perimeter size extending beyond the perimeter size of the flexible molded core panel.

The front panel is preferably trimmed to provide a strip extending beyond the perimeter size of the flexible molded core panel at its neckline and subsequent to the trimming, the strip is folded at the neckline perimeter of the flexible molded core panel and affixed to the concave side of the flexible molded core panel.

The trimming preferably defines the strip along a path parallel to the neckline perimeter.

The strip is preferably affixed by applying adhesive material on the side of the strip to become affixed.

The adhesive material is preferably a double sided adhesive tape applied to along the strip before said folding.

In a further aspect, the present invention consists in a molded breast cup of a decorative outward appearance comprising:

a. a flexible panel (herein after "front panel") which is or includes a ply of fabric material laminated to the convex side of at least part of the flexible molded core panel, the front panel being laminated in a position such that a decoratively cut perimeter thereof extends at least in part across the flexible molded core panel and is visible from its convex side, and the front panel has an appearance different than the convex side of the flexible molded core panel.

The flexible molded core panel preferably is or includes a foam ply.

The flexible molded core panel includes a base ply on its convex side to which the front panel is affixed.

A flexible panel (hereinafter "back panel") preferably is or includes a ply of fabric material affixed to the concave side of at least part of the flexible molded core panel.

The back panel is preferably affixed to the concave side of the entire flexible molded core panel.

The front panel is affixed by laminated adhesive molding.

The decoratively cut perimeter is preferably of a floral pattern.

The front panel preferably has apertures therethough which are provided in locations inward of the perimeter of the flexible molded core.

The decoratively cut perimeter is preferably defined by laser cutting or fluid jet cutting.

The decoratively cut perimeter is preferably defined prior to the front panel being affixed to the mold core.

In a further aspect, the present invention consists of a brassiere or a garment incorporating a molded breast cup as described above.

In a further aspect, the present invention consists of a molded breast cup made according to the method hereinbefore described.

BRIEF DESSCRIPTION OF THE DRAWINGS

The preferred form of the present invention will now be described with reference to the accompanying drawings in which FIG. 1 is a perspective view of a brassiere, FIG. 2 is a front view of a breast cup incorporated in the brassiere of FIG. 1, FIG. 3 is a back view of a breast cup incorporated in the brassiere of FIG. 1, FIG. 4 is a perspective view of a precursor assembly of plies of material used for manufacturing the breast cup of FIGS. 1 and 2, FIG. 5 is a sectional view through a molding device with the precursor sheet of FIG. 4 intermediate the two molding portions, FIG. 6 is a perspective view of the precursor sheet of FIG. 4 after it has been molded by the molding device of FIG. 5 having the cup form within the perimeter of the sheet, FIG. 7 is a perspective view of the cup form molded in the precursor sheet and after it has been trimmed to a perimeter shape substantially according to the cup form shown in FIGS. 2 and 3, FIG. 8 illustrates a molding device, either the same molding device or a different molding device as in FIG. 5 intermediate of which the trimmed cup form of FIG. 7 and a further flexible panel including a ply of fabric material are positioned, FIG. 9 is a plan view of the molded assembly of panels molded in the molding device shown in FIG. 8, FIG. 10 illustrates the trimming of the molded assembly of FIG. 9 wherein a strip of material is left extending beyond the perimeter of the cup form of FIG. 7, FIG. 11 is a sectional view through section A—A of FIG. 10, FIG. 12 illustrates the strip folded about a perimeter edge of the cup form to provide a trim looking edge, FIG. 13 is a perspective view of a precursor panel adapted for enhancing the visual appearance of the breast cup, FIG. 14 is a perspective view of a precursor panel after cutting of the panel to a decorative perimeter profile disposing of excess material, FIG. 15 is a perspective view of a precursor panel assembly of plies of material, FIG. 16 illustrates a molding device intermediate of which the precursor material of FIG. 15 is positioned to be molded to a three dimensional cup shape, FIG. 17 is a plan view of the sheet of FIG. 15 after molding introduces a three dimensional cup form within its perimeter, FIG. 18 illustrates the cup form trimmed from the molded panel of FIG. 17, FIG. 19 illustrates the cup form of FIG. 18 in its molded condition positioned intermediate two molding portions and adjacent to which a ply of fabric material and the ply of decorative fabric material of FIG. 14 are located for molding and adhering it to the cup form of FIG. 18, FIG. 20 is a sectional view of the molded assembly of panels of FIG. 19 showing the two fabric panels extending beyond the perimeter of the cup form of FIG. 18 and prior to being trimmed, FIG. 21 is a sectional view like FIG. 20 wherein the perimeter of the fabric plies has been trimmed, FIG. 22 in a sectional view illustrates one of the fabric plies trimmed and subsequently folded to define a trimmed edge substantially similar to that shown and created by the method with reference to FIG. 12, FIG. 23 is a sectional view through the molded assembly of panels of FIG. 19 wherein the decorative panel has been provided adjacent the neckline perimeter of the cup form, FIG. 24 illustrates a variation of FIG. 23 wherein the decorative panel has been provided trimmed to a condition so that it can be folded about the neckline perimeter of the cup to provide a trimmed edge, FIG. 25 is a front view of a cup assembly showing the decorative panel, FIG. 26 illustrates a brassiere incorporating a breast cup form according to FIG. 25 and of which FIG. 21 is a sectional view, and FIG. 27 is a front view of a brassiere wherein the decorative panel has been provided extending inwardly from the neckline perimeter and is of a configuration as shown in cross section in either FIG. 23 or 24.

DETAILED DESCRIPTION OF EMBODIMENTS OF THE INVENTION

FIG. 1 shows a brassiere 1 (hereinafter "bra") which incorporates two breast cups of either one of two or of both forms which will hereinafter be described. The bra illustrates the breast cups engaged with a chest strap and shoulder strap and affixed to each other at a mid section 2 so that it can function usefully as a breast support. It will be appreciated by a person skilled in the art that while reference herein is being made to a bra which incorporates the breast cup of the present invention, that the breast cups may alternatively be incorporated into garments of a different kind, such as for example swimsuits, evening dresses or similar.

First Preferred Embodiment of the Breast Cup

With reference to FIG. 2 there is shown a front view of a breast cup which includes a main panel portion 3, a neckline perimeter region 4, a side perimeter region 5 and a lower perimeter region 6. As used throughout this application, for convenience, such "perimeter regions" are referred to simply as "perimeters", e.g., as the neckline perimeter, the side perimeter, etc. It is to be understood, however, in accordance with the use of the word "region" in describing these perimeter locations, that the various 'perimeters' referred to include not only the exact edge of, e.g., the neckline, or the side of a breast cup, etc., but also a portion of the area (i.e. or region) adjacent thereto. That is, the word 'perimeter' as used herein refers not only to an edge but also to a portion of the area adjacent the edge boundary, with the entirety amounting to a 'perimeter region'. At or proximate the junction of the neckline perimeter 4 and the side perimeter 5 at or proximate the top 6 of the breast cup is where the breast cup is able to be engaged with shoulder straps. It will however be appreciated that in some forms of the breast cups shoulder straps need not be provided.

The breast cup is generated by a molding step or a series of molding steps of moldable panel material wherein simultaneous to molding, a three dimensional form is given to the material. The steps also laminate the plies forming the main panel together. The technique of molding is well known and will not hereinafter be described in detail.

The breast cup of this aspect of the invention incorporates a panel of flexible material on the convex outward side of the cup form. That panel allows a trimmed edge to be created at at least part of the neckline perimeter and preferably at all of the neckline perimeter of the breast cup. FIG. 1 shows that the neckline perimeter 4 of the breast cup remains a free edge of the breast cup after incorporation with other components to define a bra. The other perimeter edges 5, 6 are engaged to other components of a bra preferably by for example sewing or otherwise affixing. However, because the neckline perimeter is an edge that remains exposed, it should be finished in a manner that maintains the integrity of the edge. That is achieved by the folding part of the exterior most ply or panel of material (to the convex side of the breast cup) over the neckline perimeter edge 4.

A method for forming a breast cup of the form as shown in FIGS. 2 and 3 is described.

FIG. 4 shows a perspective view of a precursor panel of material (hereinafter "core panel"). The core panel 7 may consist of two plies of material comprising a first ply of a foam ply 8 and a second ply of a flexible fabric ply 9. Further plies may also be provided. For example, the foam ply may be sandwiched between two fabric plies. The plies are laminated together by an appropriate lamination technique such as adhesive lamination and/or heat bonding lamination. The foam ply 8 is preferably of a thickness of 1 mm to 10 mm. It is made from a material such as urethane foam. The fabric ply 9 is preferably of a polyester based cotton, LYCRA® spandex, spandex or nylon fabric. Both plies are provided in a coextensive manner relative to each other in their precursor laminated form. The core panel 7 is subjected to a molding process utilizing a mold consisting of upper and lower mold portions intermediate which the core panel 7 is positioned. The mold portions 10 include a breast cup form each of a complementary shape, to introduce a breast cup shape into the core panel 7. The fabric ply 9 is provided to the concave forming side of the mold portion and the foam ply is provided on the convex side. Once the breast cup form has been molded into the core panel 7, for example in FIG. 6, and with the foam ply being on the convex side, the cup form 12 is cut out of the core panel 7 to provide a three dimensional breast cup form and perimeter trimmed molded core panel 12 as shown in FIG. 7.

The molded core panel 12 is then introduced into a molding device consisting of mold portions 16, along with a flexible panel 17 which is or includes a ply of fabric material. The panel 17 is a covering panel placed at the convex side of the molded core panel 12 providing a fabric ply. The molded core panel 12 is positioned within the mold such that the fabric ply 9 is provided to the concave side and the foam ply is provided to the convex side. The covering panel 17 may also be an assembly of laminated plies. In the most preferred form, a fabric ply is the exterior and convex most side ply of any such assembly of covering panel 17.

Upon molding of the panels 12 and 17, their assembly in a molded breast cup form 18 is provided, as for example in FIG. 9. The part of panel 17 that extends beyond the perimeter of the core panel cup form 12 is at the convex side thereof and is trimmed to substantially the same perimeter as the molded core panel form 12. However in FIG. 10, the panel 17 is trimmed to provide a strip of material 19 extending beyond the neckline perimeter 4 of the molded core panel 12. In FIG. 10, which is a concave side view of the assembly of panels 18, the strip 19, which is part of the panel 17, extends beyond the neckline perimeter 4 and runs substantially parallel therewith. It is to be appreciated that the strip 19 may be a pre-cut or cut once panel 17 affixed to the molded core panel 12.

FIG. 11 shows the strip 19 that extends beyond the neckline perimeter 4 of the molded core panel 12 preferably consists of the foam ply 8 and the fabric ply 9. The strip 19 is folded about the neckline perimeter 4 of the cup form to provide a trim to the neckline perimeter 4 of the assembly of panels 18. The folded strip 19 is engaged to the concave side of the molded core panel 12, preferably directly to the concave side of the fabric ply 9. The strip 19 may be affixed to the concave side of the fabric ply 9 by an adhesive zone 20 which extends along the strip 19. The adhesive zone 20 may comprise a double sided adhesive tape or a contact adhesive applied to the strip 19 prior to it being folded and engaged with the concave side of the molded core panel 12.

The strip 19 is preferably of a constant width extending outwardly from the neckline perimeter 4 prior to being folded over, so that when it is folded, it provides a substantially parallel to the neckline perimeter 4 edge inwardly of the neckline perimeter 4 and on the concave side of the assembly of panels.

While not shown, such a trim may be provided to other perimeter edges of the breast cup form. The bottom perimeter edge 6 may also have such a trim provided by the folding of the outward most fabric ply about the perimeter of the molded core panel 12.

The trim about at least part of one of the perimeter edges of the breast cup form avoids exposure of the edge of the foam ply and any of the other plies of the core panel 12, as the folding of the strip about the perimeter edge captures the exposed edges of the plies of the core panel 12 within the fold. This ensures that the integrity of such edges which have been captured cannot be adversely affected.

Second Preferred Embodiment of the Breast Cup

In an alternative form of a breast cup assembly which may or may not include the trim provided and described with reference to FIGS. 2 to 12, is a breast cup having a decorative exterior appearance. The decorative exterior appearance is provided by the provision of a fabric panel at the convex side of a breast cup. In the most preferred form the decorative panel is of a fabric material and consists of a ply of fabric material 26 which has had a "perimeter" shape provided therein which is of a decorative appearance such as one replicating petals of a flower, or a profile of numerals or letters. As noted in the discussion above of the first preferred embodiment of the invention, the word "perimeter" as used throughout this description means a 'perimeter region', as above, wherein the region includes not only the edge, but also a portion of the area (i.e., the region) surrounding and adjacent thereto. With reference to FIG. 14, the decorative fabric ply 26 has been cut to provide a perimeter shape 27 which is of a profile which has a decorative appearance. The fabric ply 26 may also have had apertures 28 cut therein. The fabric ply 26 has preferably such a profile or perimeter shape generated by the use of a cutting device such as a laser cutter or a fluid jet cutter. Such a device can be programmed to accurately and quickly cut a perimeter shape or profile to the fabric material 26 including a shape of a very complex form.

The breast cup form which incorporates the decorative appearance incorporates a panel (hereinafter a "core panel") 29 which may consist of a first ply of preferably a foam material 30 and a second ply of preferably a fabric material 31 which has been laminated to the foam ply 30 by adhesive and/or heat bonding. The materials may for example be the same as described above. The two plies 30 and 31 are preferably coextensive and are molded to a three dimensional cup form 40 by a molding device 41 as for example shown in FIG. 16. The cup form 40 generated in the core panel 29 provides the fabric ply 31 to the concave side and the foam ply 30 to the convex side. There may be additional plies, and for example, the foam ply may be sandwiched between two fabric plies.

Once it is molded, the breast cup form 40 is then trimmed to remove the perimeter material of the core panel 29. It may then be subjected to a further molding/laminating by the molding device 42. Within the molding device 42, the molded breast cup form core panel 40 is positioned with its fabric ply 31 to the concave side and the foam ply 30 to the convex side. The plies 44 and 26 overlay the convex side of the core panel 40. The plies 44 and 26 may have previously been laminated to each other or may alternatively be independent of each other prior to molding in the molding device 42.

The ply 44 is preferably also of a fabric material and preferably is of a contrasting appearance to the ply 26. Such contrasting appearance may be in color and/or in texture. The ply 44 is preferably a single ply of fabric material. However, it may alternatively be an assembly of plies which are laminated together including a fabric ply to the convex side of the assembly. The assembly of plies 44 may provide a fabric ply towards the concave side of a foam ply.

The decorative fabric ply 26 is so positioned within the molding device that after the breast cup form has been molded, its decorative edge 27 extends across the breast cup form, at least in part across the breast cup form or across the entire breast cup form from one perimeter portion to another. Accordingly once the breast cup form has been molded as in FIG. 25, the decorative edge 27 is visible across the breast cup form and provides a contrast to the fabric ply 44. Once the decorative fabric ply 26 and the fabric ply 44 have been molded and affixed to the core assembly 40, its perimeter edges can be trimmed appropriately. A trimmed form is for example shown in FIG. 21. The fabric ply 44 and/or the decorative panel may be trimmed so that a perimeter thereof may be folded about the perimeter of the core assembly 40. Such a folding is for example shown in FIG. 22 or in FIG. 24. It can allow for such a fabric ply (ply 44 or 26 or both) to provide a trim to a perimeter of the breast cup form. Creating such a trim by folding can allow for the perimeter edges of core panel captured by the ply 44 so folded to have enhanced integrity. Such a perimeter may remain a free edge of the breast cup form and such trimming is desirable to prevent washing or other treatment of the bra from destroying the appearance of such a free edge. The strip of fabric material which is folded about the perimeter of the core assembly 40 may be affixed to the concave side of the core assembly 40 by adhesive.

FIG. 25 shows the fabric ply 26 providing the decorative perimeter 27 towards the lower regions of the breast cup thereby exposing the fabric ply 44 at or towards the upper regions. The fabric ply 26 also includes apertures 60 through which the fabric ply 44 is exposed.

Figure 1:
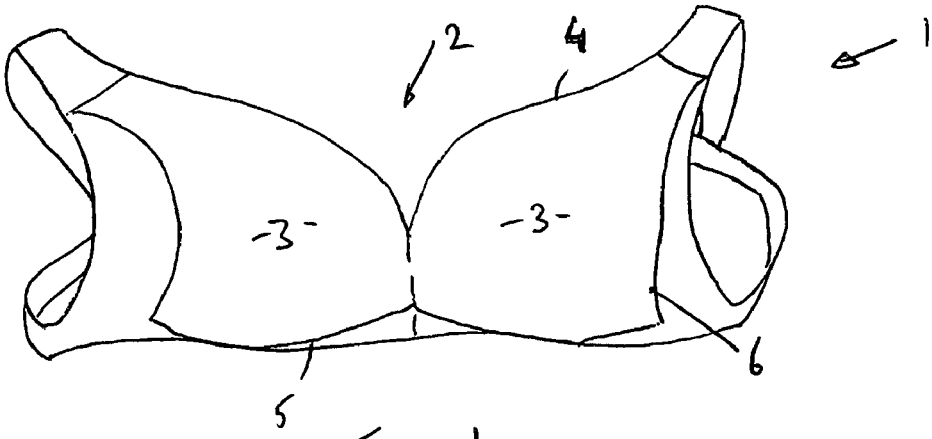
Figure 2:
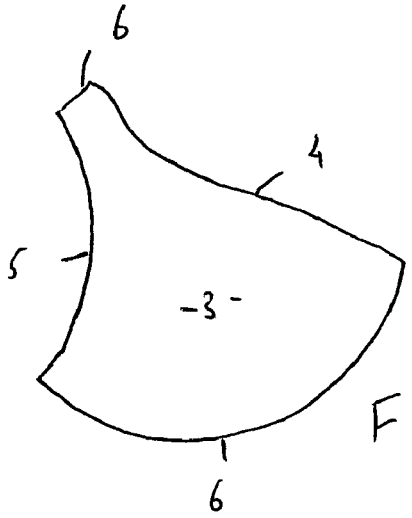
Figure 3:
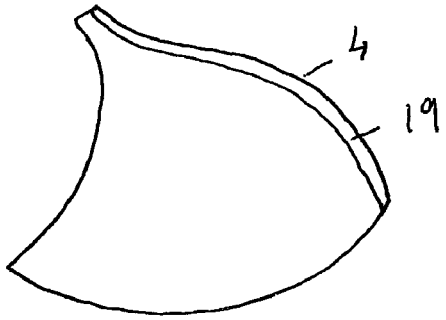
Figure 4:
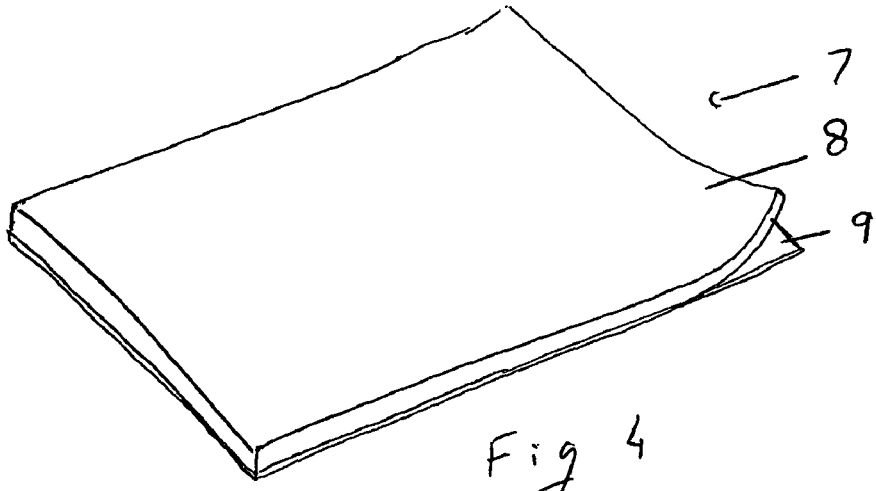
Figure 5:
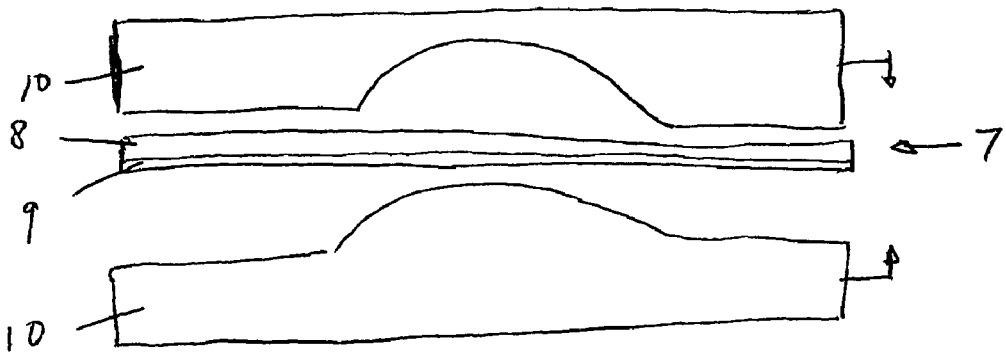
Figure 6:
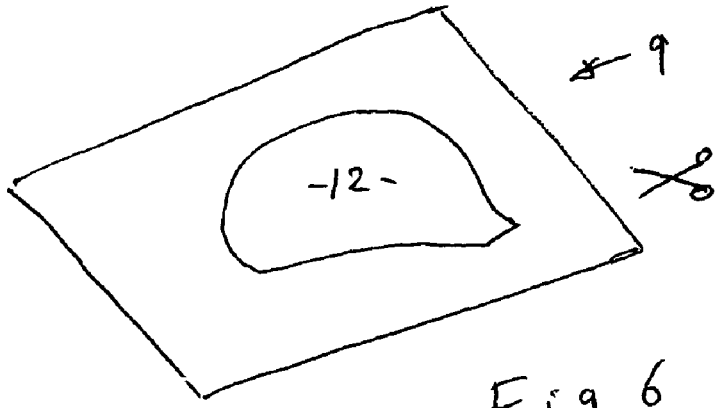
Figure 7:
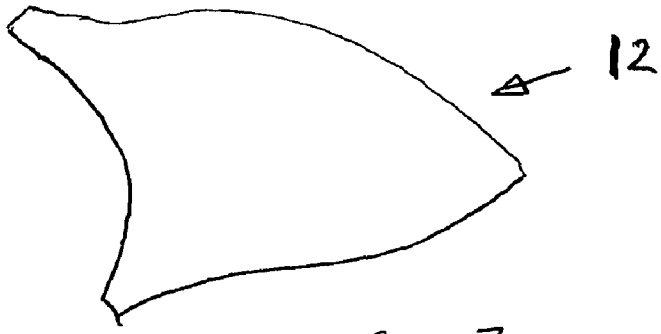
Figure 8:
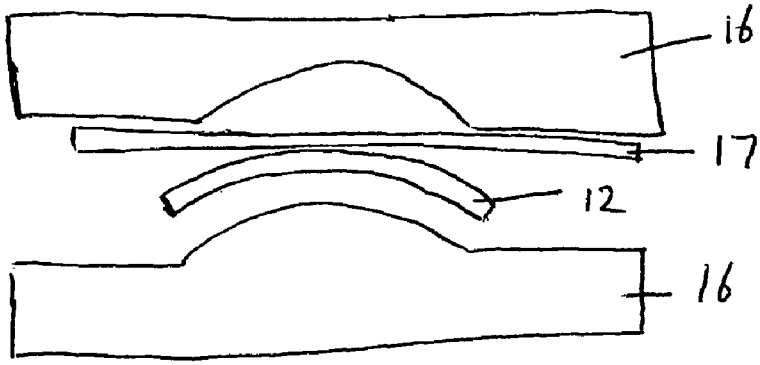
Figure 9:
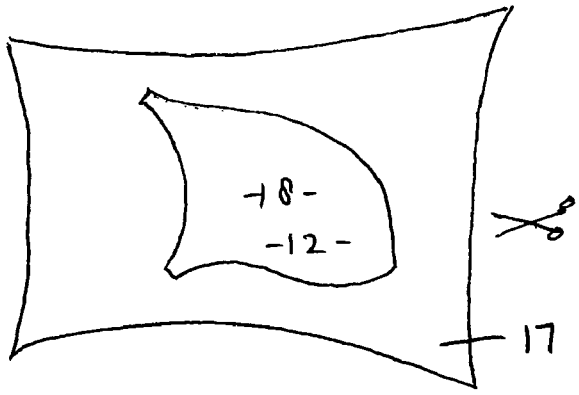
Figure 10:
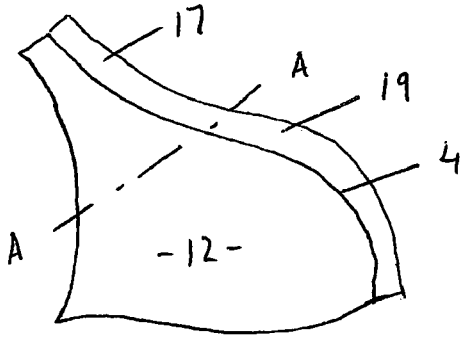
Figure 11:
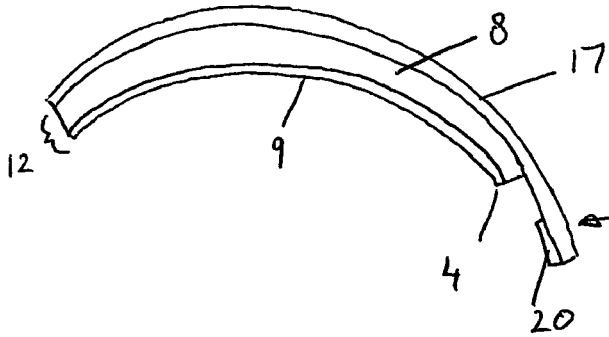
Figure 12:
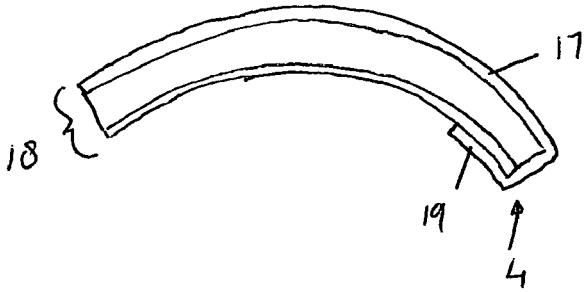
Figure 13:
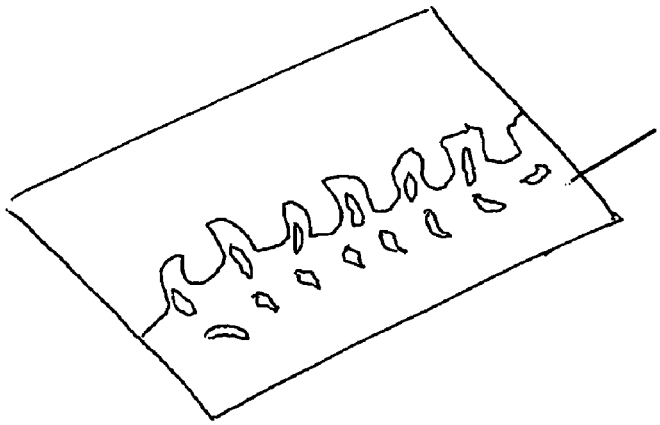
Figure 14:
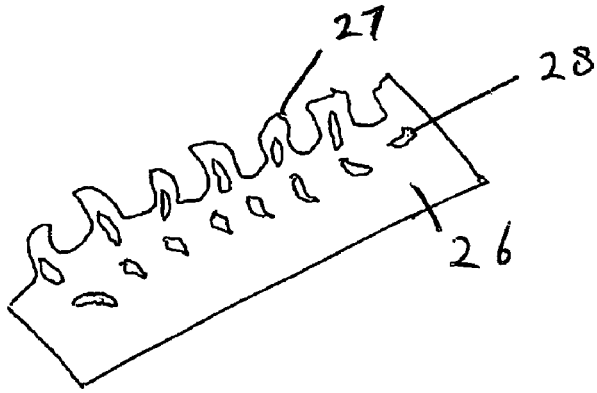
Figure 15:
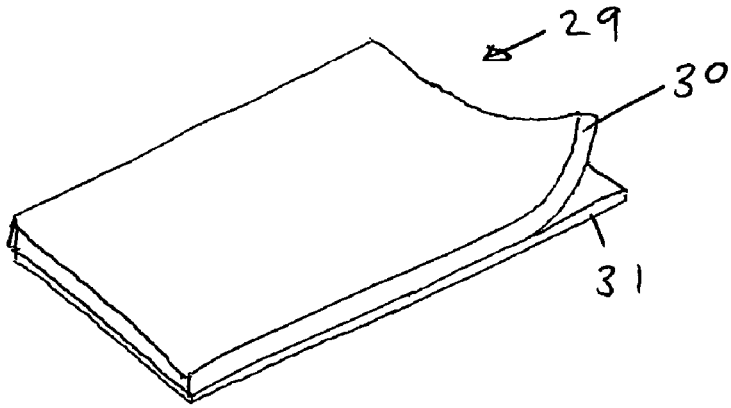
Figure 16:
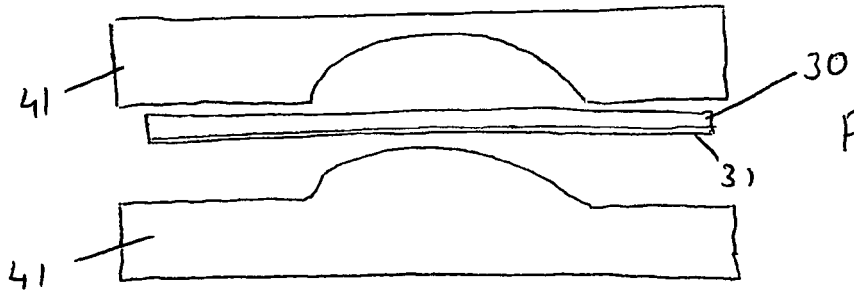
Figure 17:
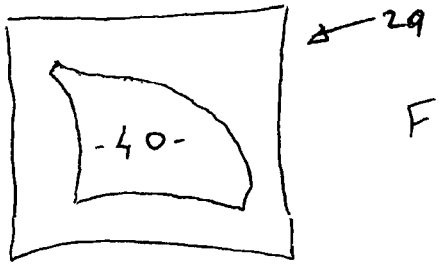
Figure 18:
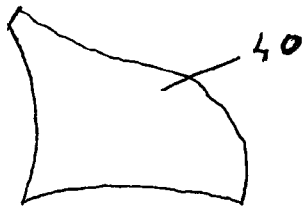
Figure 19:
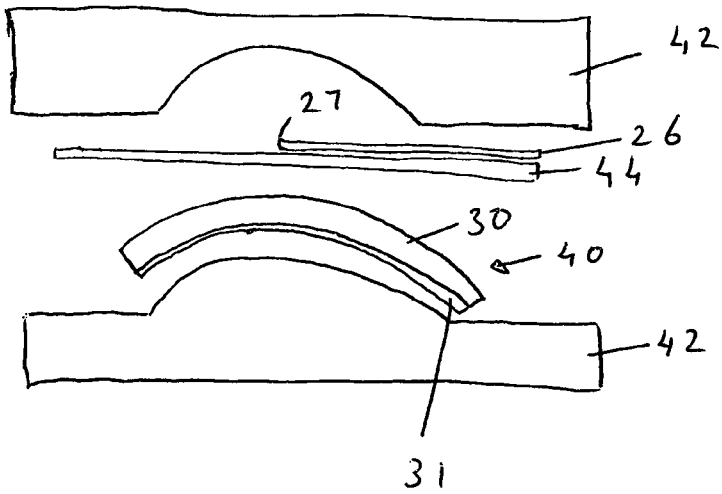
Figure 20:
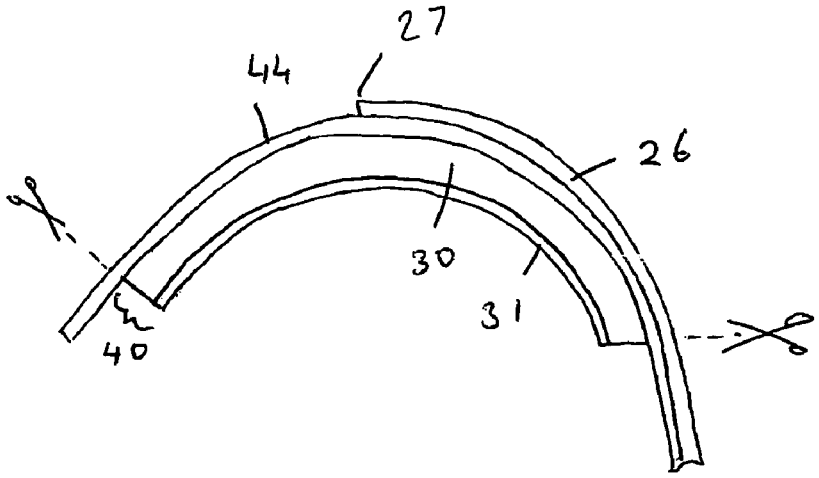
Figure 21:
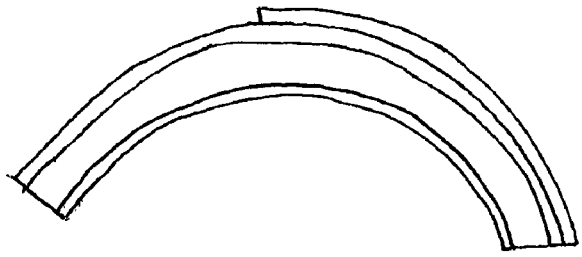
Figure 22:
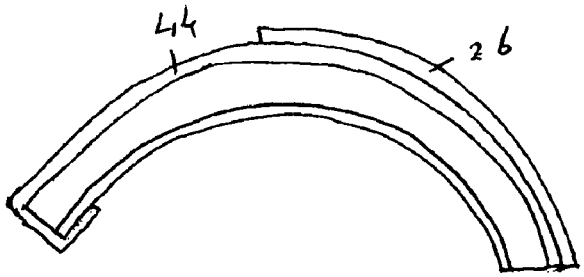
Figure 23:
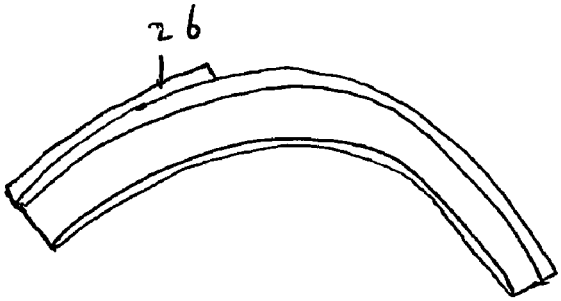
Figure 24:
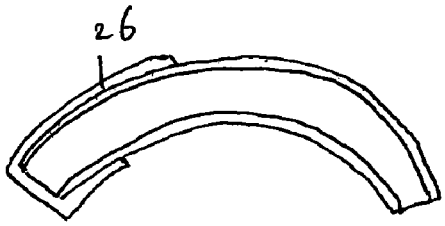
Figure 25:
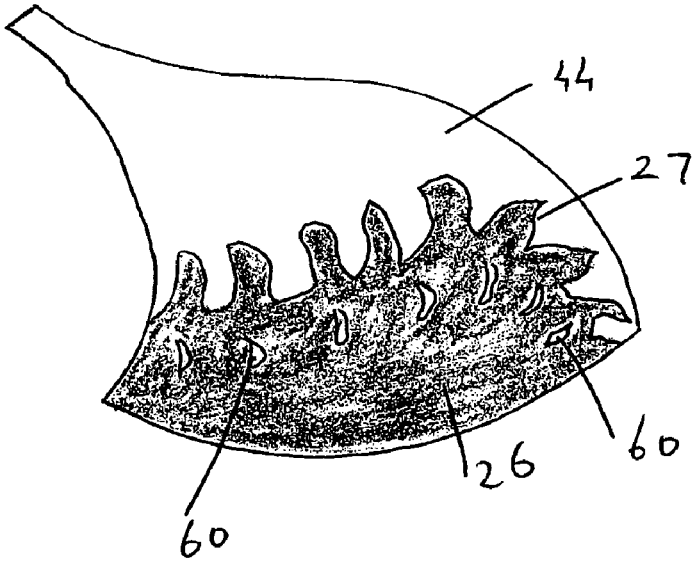
Figure 26:
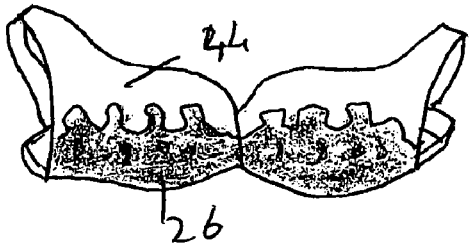
FIG. 26 illustrates the breast cup of FIG. 25 incorporated into or as part of a brassiere.
Figure 27:
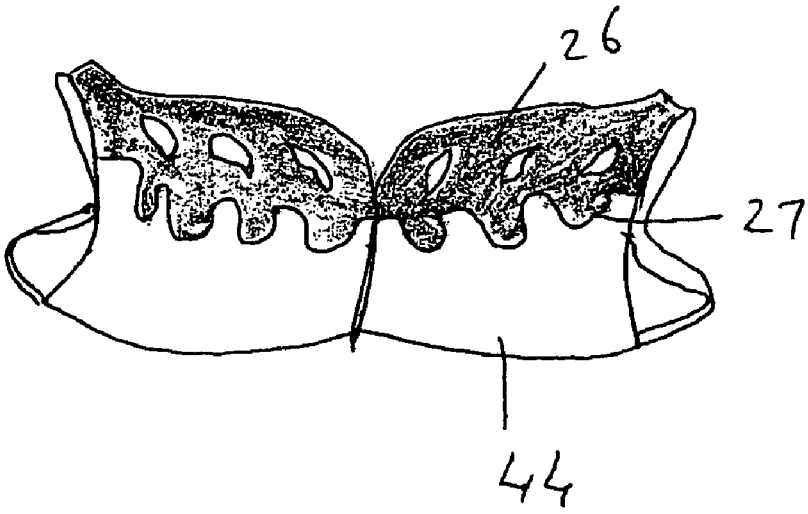
FIG. 27 shows a brassiere which includes breast cups where the fabric ply provides the decorative perimeter 27 at the upper regions and this may for example have a cross section as for example shown in FIG. 24. The fabric ply providing the decorative perimeter is provided at the upper regions, thereby exposing the fabric ply 44 there below.

While reference has herein been made to the provision of various panels or plies engaged to each other, it will be appreciated by a person skilled in the art that intermediate panels or part panels or plies may be provided between those described in the most preferred form. As has already been mentioned the foam ply of the core panel may be captured between one or more plies disposed on each side thereof. The mold forming and adhesion of the decorative fabric ply 26 is such that it ensures a sufficiently strong bond is achieved between it and the ply or panel of material, such as the fabric ply 44 therebelow.

The invention claimed is:

1. A method of making a breast cup for a garment of clothing comprising the steps of:

(a) providing a flexible molded core panel which includes at least a foam ply, said flexible molded core panel having been molded and its perimeter trimmed to a breast cup form including a neckline perimeter trimmed to a desired neckline perimeter shape, and molded such that said core panel has a convex side and a concave side;

(b) affixing a flexible front panel which is or includes a ply of fabric material, to said convex side of at least part of said core panel, wherein said front panel is affixed in a position such that (i) at least part of a perimeter of said front panel extends beyond said neckline perimeter of said molded breast cup form of said flexible molded core panel, for defining a strip of said front panel extending beyond and along at least part of said neckline perimeter, and (ii) said front panel is shaped to said core panel and said ply of fabric material of said front panel is a convex side of said front panel, (c) folding said strip over said neckline perimeter, and (d) affixing said folded over strip along said flexible molded core panel at said concave side of said core panel.

2. A method as claimed in claim 1 further comprising after said affixing of said front panel and before said folding of said strip, cutting said front panel along a path outwardly of said neckline perimeter of said flexible molded core panel to define said strip.

3. A method as claimed in claim 1 wherein prior to affixing said front panel to said flexible molded core panel, said front panel has been pre-cut at least at a perimeter thereof to extend adjacent said neckline perimeter of said flexible molded core panel.

4. A method as claimed in claim 3 further comprising said flexible molded core panel concave side having a flexible back panel which is or includes a ply of fabric material and affixing said ply of fabric material of said back panel to said foam ply prior to said affixing of step (b) to said foam ply of said core panel, such that said ply of fabric material is at said concave side of said back panel, and wherein said affixed back panel is of the same perimeter shape as said foam ply, wherein said affixing of step (d) directly engages said strip to said back panel.

5. A method as claimed in claim 1 wherein said affixing step (a) is an adhesive affixing; placing said front panel and said flexible molded core panel to be pressed together in a molding device having two mold portions each with a complementary cup shaped molding surface and pressing said front panel and said core panel together to be molded.

6. A method as claimed in claim 1 wherein said affixing step (b) is by adhesive pressure molding.

7. A method as claimed in claim 1 wherein said affixing step (b) includes use of adhesive.

8. A method as claimed in claim 1 wherein said affixing step (b) is by elevated temperature melt bonding.

9. A method as claimed in claim 2 wherein prior to said cutting thereof, said front panel has a perimeter extending beyond all of a perimeter size and said neckline perimeter shape of said flexible molded core panel.

10. A method as claimed in claim 1 wherein said folding step (c) is for creating a fold line of said front panel at said neckline perimeter of said flexible molded core panel.

11. A method as claimed in claim 2 wherein said cutting step to define said strip is along a path parallel to said neckline perimeter.

12. A method as claimed in claim 2 wherein said cutting step to define said strip is along a path parallel to and less that 5 cm away from said neckline perimeter.

13. A method as claimed in claim 1 wherein said strip has a side that is to be affixed to said core panel; and said affixing step (d) comprises providing adhesive material to said strip on said side thereof to become affixed.

14. A method as claimed in claim 13 wherein said adhesive material is a double sided adhesive tape applied along said strip before said folding step.

15. A method as claimed in claim 1 wherein once said front panel is affixed, said front panel has at least part of a perimeter within a perimeter of said flexible molded core panel, and said flexible molded core panel including a base ply of flexible fabric material disposed at said convex side of said core panel and positioned intermediate front panel and said flexible molded core panel.

16. A method as claimed in claim 1 wherein said flexible molded core panel includes a base ply of flexible fabric material disposed to a convex side of said foam ply and positioned intermediate said front panel and said foam ply.

17. A method as claimed in claim 16 wherein said ply of fabric material of said front panel has been cut prior to said affixing step (a) to provide a decorative shape perimeter, and positioning said decorative shape perimeter after said affixing of step (a) inward of said perimeter of said flexible molded core panel.

18. A method as claimed in claim 17 wherein said ply of fabric material of said front panel is of a first color different than a second color of said base ply.

19. A method as claimed in claim 1 wherein said front panel is only of said ply of fabric material.

20. A method of making a breast cup for a garment of clothing comprising the steps of:

(a) providing a flexible molded core panel which includes at least a foam ply, said flexible molded core panel having been molded and perimeter trimmed to a breast cup form including a neckline perimeter trimmed to a desired neckline perimeter shape and molded such that said core panel has a convex side and a concave side, (b) affixing a flexible back panel which is or includes a ply of fabric material, to said concave side of at least part of said core panel wherein said back panel is affixed in a position such that (i) at least part of a perimeter of said back panel extends beyond said neckline perimeter of said molded breast cup form of said flexible molded core panel, for defining a strip of said back panel extending beyond and along at least part of said neckline, and (ii) said ply of fabric material of said back panel is at said concave side of said back panel, (c) folding said strip over said neckline perimeter and (d) affixing said folded over strip along said flexible molded core panel at said convex side of said core panel.

21. A method as claimed in claim 20 wherein after said affixing step (d) affixing a flexible front panel which includes a ply of fabric material to said convex side of said flexible molded core panel, wherein said front panel is of a size larger than a perimeter size of said flexible molded core panel.

22. A method as claimed in claim 21 further comprising trimming said front panel to the same perimeter size as said flexible molded core panel.

23. A molded breast cup construction comprising:

(a) a flexible molded core panel which includes at least a foam ply which has been molded and trimmed to a breast cup form and said breast cup form includes a neckline perimeter and a convex side and a concave side, (b) a flexible front panel which is or includes a ply of fabric material affixed to said convex side of at least part of said flexible molded core panel, said front panel being affixed in a position on said core panel such that a perimeter strip of said front panel extends along said neckline perimeter and is affixed to said concave side of said flexible molded core panel.

24. A molded breast cup as claimed in claim 23 wherein said core panel and said front panel have a same respective perimeter shape.

25. A molded breast cup as claimed in claim 23 wherein said perimeter strip is of a constant width along said neckline perimeter.

26. A molded breast cup as claimed in claim 23 wherein said perimeter strip extends along the entire said neckline perimeter of said flexible molded core panel.

27. A molded breast cup as claimed in claim 23 wherein said flexible molded core panel includes a base ply on said convex side thereof to which said front panel is affixed.

28. A molded breast cup as claimed in claim 23 further comprising a flexible back panel including a ply of fabric material affixed to said concave side of at least part of said flexible molded core panel.

29. A molded breast cup as claimed in claim 28 wherein said back panel is affixed to said concave side of the entire said flexible molded core panel.

30. A molded breast cup as claimed in claim 23 wherein except for at said neckline perimeter thereof, said front panel is cut to define a decorative perimeter shape which extends across said flexible molded core panel, said front panel having an appearance different from an appearance of said convex of said flexible molded core panel.

31. A molded breast cup as claimed in claim 23 wherein said front panel is affixed by laminated adhesive molding.

32. A brassiere incorporating a molded breast cup as claimed in claim 23.

33. A garment incorporating a molded breast cup as claimed in claim 23.

34. A method of making a decorative molded breast cup for a garment of clothing comprising the steps of:—

(a) providing a flexible molded core panel which includes at least a foam ply which has been molded and trimmed to a breast cup form, said core panel having a convex side and a concave side;

(b) affixing a flexible front panel which is or includes a ply of fabric material and wherein said front panel has had part of a perimeter thereof cut to define a decorative perimeter, to said convex side of at least part of said molded core panel, wherein said front panel is affixed in a position on said core panel such that said decorative perimeter of said flexible front panel extends across at least part of said flexible molded core panel, said front panel being of a contrasting first appearance to a second appearance of said convex side of said molded core panel.

35. A method as claimed in claim 34 further comprising trimming any portions of said front panel extending beyond said perimeter of said flexible molded core panel to a desired perimeter shape.

36. A method as claimed in claim 34 wherein said trimming is of portions of said front panel extending beyond said perimeter of said flexible molded core panel to a perimeter shape that is the same as a perimeter of said flexible molded core panel.

37. A method as claimed in claim 35 wherein said front panel is of a contrasting first color to a second color of said convex side of said flexible molded core panel.

38. A method as claimed in claim 35 wherein said front panel also has a non-decorative perimeter that is not at said decorative perimeter; prior to said trimming, affixing of said front panel to said core panel in a position such that said decorative perimeter edge extends across at least part of said flexible molded core panel and a non-decorative perimeter of said front panel extends beyond said perimeter of said flexible molded core panel.

39. A method as claimed in claim 34 wherein said flexible molded core panel includes a base ply of a flexible fabric material provided at said convex side of said foam ply and said front panel is affixed to said flexible fabric material.

40. A method as claimed in claim 39 wherein said base ply shape and said foam ply have a same perimeter shape.

41. A method as claimed in claim 34 wherein said decorative perimeter shape of said front panel has been created by laser cutting.

42. A method as claimed in claim 34 wherein said decorative perimeter shape of said front panel has been created by fluid jet cutting.

43. A method as claimed in claim 34 wherein said front panel has a perimeter and at least one aperture inward of said perimeter.

44. A method as claimed in claim 43 wherein said at least one aperture has been created by laser cutting.

45. A method as claimed in claim 43 wherein said at least one aperture has been created by fluid jet cutting.

46. A method as claimed in claim 34 wherein said affixing of step (b) comprises adhesive affixing and is facilitated by a molding device having two mold portions each with a complementary cup shaped molding surface, and said front panel and said flexible molded core panel are placed to be pressed together between said molding surfaces.

47. A method as claimed in claim 34 wherein said affixing of step (b) is by adhesive pressure molding.

48. A method as claimed in claim 34 wherein said affixing of step (b) includes use of adhesive.

49. A method as claimed in claim 34 wherein said affixing of step (b) is by elevated temperature melt bonding.

50. A method as claimed in claim 34 wherein prior to said trimming, said front panel is at least in part of a perimeter size extending beyond a perimeter size of said flexible molded core panel.

51. A method as claimed in claim 34 further comprising trimming said front panel to provide a strip extending beyond a perimeter size of said flexible molded core panel at a neckline thereof and subsequent to said trimming, folding said strip over said neckline perimeter of said flexible molded core panel and affixing said folded over strip to said concave side of said flexible molded core panel.

52. A method as claimed in claim 51 wherein said trimming defines said strip along a path parallel to said neckline perimeter.

53. A method as claimed in claim 51 wherein said affixing of said strip is by providing adhesive material to said strip on a side of said strip to become affixed after being folded over.

54. A method as claimed in claim 51 wherein said adhesive material is a double sided adhesive tape applied to said strip and extending along said strip before said folding.

55. A molded breast cup of a decorative outward appearance comprising:

(a) a flexible molded core panel which includes at least a foam ply which has been molded to a breast cup form and has a convex side and a concave side;

(b) a flexible front panel which has a decoratively cut perimeter and is or includes a ply of fabric material laminated to said convex side of at least part of said flexible molded core panel, said front panel being laminated in a position such that said decoratively cut perimeter extends at least in part across said flexible molded core panel and is visible from said convex side thereof, said front panel having a first appearance different from a second appearance of said convex side of said flexible molded core panel.

56. A molded breast cup as claimed in claim 55 wherein said flexible molded core panel is or includes a foam ply.

57. A molded breast cup as claimed in claim 55 wherein said flexible molded core panel includes a base ply on said convex side thereof to which said front panel is affixed.

58. A molded breast cup as claimed in claim 55 further comprising a flexible back panel which includes a ply of fabric material affixed to said concave side of at least part of said flexible molded core panel.

59. A molded breast cup as claimed in claim 58 wherein said back panel is affixed to said concave side of said flexible molded core panel.

60. A molded breast cup as claimed in claim 55 wherein said front panel is affixed by laminated adhesive molding.

61. A molded breast cup as claimed in claim 55 wherein said decoratively cut perimeter is of a floral pattern.

62. A molded breast cup as claimed in claim 55 wherein said front panel has apertures which are at locations inward of said perimeter of said flexible molded core.

63. A molded breast cup as claimed in claim 55 wherein said decoratively cut perimeter has been defined by laser cutting.

64. A molded breast cup as claimed in claim 55 wherein said decoratively cut perimeter has been defined by fluid jet cutting.

65. A molded breast cup as claimed in claim 55 wherein said decoratively cut perimeter has been defined prior to said front panel being affixed to said mold core.

66. A brassiere incorporating a molded breast cup as claimed in claim 55.

67. A garment incorporating a molded breast cup as claimed in claim 55.

* * * * *

UNITED STATES PATENT AND TRADEMARK OFFICE

CERTIFICATE OF CORRECTION

PATENT NO. : 7,166,012 B2
APPLICATION NO. : 10/860102
DATED : January 23, 2007
INVENTOR(S) : Bull Lau It is certified that error appears in the above-identified patent and that said Letters Patent is hereby corrected as shown below:

On the Title Page,
Item (75) Inventor should read:
Zhen Qiang Liu (Also known as Bull Lau), Hong Kong (HK)

Signed and Sealed this

Sixteenth Day of September, 2008

JON W. DUDAS
*Director of the United States Patent and Trademark Office*